US009517854B2

(12) United States Patent
Zardini

(10) Patent No.: US 9,517,854 B2
(45) Date of Patent: Dec. 13, 2016

(54) MACHINE AND METHOD FOR TREATING CONTAINERS OF LIQUIDS

(71) Applicant: Fabio Zardini, Castelfranco Veneto (TV) (IT)

(72) Inventor: Fabio Zardini, Castelfranco Veneto (TV) (IT)

(73) Assignee: STEELCO SPA, Riese Pio X (TV) (IT)

( * ) Notice: Subject to any disclaimer, the term of this patent is extended or adjusted under 35 U.S.C. 154(b) by 672 days.

(21) Appl. No.: 13/932,378

(22) Filed: Jul. 1, 2013

(65) Prior Publication Data

US 2014/0000220 A1 Jan. 2, 2014

(30) Foreign Application Priority Data

Jul. 2, 2012 (IT) ..... UD2012A0121

(51) Int. Cl.

| | |
|---|---|
| ***B65B 57/00*** | (2006.01) |
| ***B08B 3/02*** | (2006.01) |
| ***B08B 9/20*** | (2006.01) |
| ***B08B 9/30*** | (2006.01) |
| ***B67B 1/03*** | (2006.01) |
| ***B67C 7/00*** | (2006.01) |
| *B67B 3/00* | (2006.01) |

(52) U.S. Cl.

CPC ..... *B65B 57/00* (2013.01); *B08B 3/022* (2013.01); *B08B 9/20* (2013.01); *B08B 9/30* (2013.01); *B67B 1/03* (2013.01); *B67C 7/0033* (2013.01); *B67B 3/003* (2013.01)

(58) Field of Classification Search

CPC ..... B65B 57/00; B08B 3/022; B08B 9/20; B08B 9/30; B08B 9/28; B08B 9/42; B67B 1/03;B67B 3/003; B67B 2201/08; B67C 7/0033; B67C 2003/228; B67C 7/0006; B67C 7/0013; B67C 7/002; B67C 7/0026; B67C 2007/006; B67C 2007/0066

USPC ..... 53/426, 167, 425, 381.4, 468, 471

See application file for complete search history.

(56) References Cited

U.S. PATENT DOCUMENTS

| | | | | |
|---|---|---|---|---|
| 1,958,846 | A | 5/1934 | Christensen | |
| 2,532,900 | A * | 12/1950 | Lauve | B67B 3/02 100/153 |
| 2,695,125 | A * | 11/1954 | Bowen | B67B 3/00 198/444 |
| 2,786,479 | A | 3/1957 | Dungfelder et al. | |
| 2,828,593 | A * | 4/1958 | Colgren | B65B 7/28 53/287 |

(Continued)

FOREIGN PATENT DOCUMENTS

| | | |
|---|---|---|
| DE | 4116333 | 11/1992 |
| DE | 102008046608 | 5/2010 |

(Continued)

*Primary Examiner* — Robert Long
*Assistant Examiner* — Lucas Palmer
(74) *Attorney, Agent, or Firm* — Hamre, Schumann, Mueller & Larson, P.C.

(57) ABSTRACT

A machine (10) for treating containers (12) and corresponding lids (11) in order to contain a liquid for feeding animals comprises a first line (50) for washing, treating and filling the containers (12), from which the lids (11) have been removed beforehand, disposed in a first washing direction (X), and a second line (60) for washing and treating the lids (11) removed from the containers (12) disposed in a second washing direction (Y) disposed parallel to the first direction (X).

12 Claims, 3 Drawing Sheets

(56) References Cited

U.S. PATENT DOCUMENTS 2,845,759 A * 8/1958 Cote ..... B65B 5/103 221/68
2,931,147 A * 4/1960 Barnby ..... B65B 31/046 53/381.4
3,058,276 A * 10/1962 Palma ..... A61J 9/00 141/92
3,431,702 A * 3/1969 Spaulding ..... B65B 21/16 414/627
3,545,174 A * 12/1970 Randrup ..... B67B 7/164 29/700
3,803,795 A * 4/1974 Ouellette ..... B67B 7/182 53/381.4
3,938,532 A * 2/1976 Babunovic ..... B08B 9/205 134/126
3,987,535 A * 10/1976 Brown ..... B67B 7/182 29/426.4
4,030,271 A * 6/1977 Kefauver ..... B67B 3/2006 53/305
4,061,236 A * 12/1977 Schneerson ..... B08B 9/20 198/604
4,070,854 A * 1/1978 Marino ..... B67B 7/164 53/381.4
4,094,329 A * 6/1978 Evans ..... B08B 9/28 134/152
4,104,081 A * 8/1978 Totten ..... B08B 9/205 134/129
4,304,611 A * 12/1981 Ellis ..... B08B 3/02 134/127
4,446,674 A * 5/1984 Inada ..... B65B 55/022 141/114
4,635,509 A * 1/1987 Nagao ..... B67B 7/164 53/381.4
5,048,259 A * 9/1991 Cox ..... B65B 7/2842 53/132.1
5,050,367 A * 9/1991 Heisler ..... B65B 7/2807 53/313
5,409,545 A * 4/1995 Levey ..... B08B 9/205 134/129
5,488,899 A * 2/1996 Jennings ..... B08B 9/20 100/102
6,199,347 B1 * 3/2001 Muller ..... B65B 7/164 53/167
6,256,964 B1 * 7/2001 Drevfors ..... B65B 55/025 53/109
6,475,435 B1 * 11/2002 Taggart ..... B67C 7/0033 422/28
6,481,468 B1 * 11/2002 Taggart ..... B67C 7/0033 134/169 R
6,536,188 B1 * 3/2003 Taggart ..... B67C 7/0073 141/1
6,575,290 B2 * 6/2003 Loning ..... B08B 9/28 198/494
6,581,614 B1 * 6/2003 Gotfried ..... A47L 15/0065 134/105
6,919,043 B2 * 7/2005 Hayakawa ..... A61L 2/04 422/28
6,991,002 B2 * 1/2006 Osborne ..... B65B 3/003 141/21
7,322,170 B2 * 1/2008 Tomalesky ..... B65B 7/2835 141/129
7,360,345 B2 * 4/2008 Topf ..... A61L 2/18 53/290
7,980,046 B2 * 7/2011 Yousefpour ..... B08B 3/02 53/167
8,267,101 B2 * 9/2012 Beard ..... B08B 9/28 134/129
8,356,461 B2 * 1/2013 Cedrone ..... B67C 7/0033 53/284.5
2003/0009985 A1 * 1/2003 Close ..... B65B 7/28 53/76
2003/0056466 A1 * 3/2003 Muneyasu ..... B65B 3/003 53/75
2003/0165400 A1 * 9/2003 Hayakawa ..... A61L 2/04 422/28
2005/0150193 A1 * 7/2005 Bernhard ..... B67B 3/2033 53/490
2011/0072759 A1 * 3/2011 Mielnik ..... A61L 2/208 53/167
2012/0110952 A1 * 5/2012 Zardini ..... B08B 3/022 53/425
2012/0111371 A1 * 5/2012 Zardini ..... B08B 9/205 134/23
2012/0186200 A1 * 7/2012 Jones ..... G01N 35/04 53/471
2012/0279177 A1 * 11/2012 Macquet ..... B65B 7/2835 53/426

FOREIGN PATENT DOCUMENTS

EP 0017287 10/1980
EP 0349502 1/1990
EP 0673041 9/1995
EP 0824974 2/1998
FR 1039114 10/1953
IT WO 2010140043 A2 * 12/2010 ..... B08B 3/022
IT WO 2010140048 A2 * 12/2010 ..... B08B 3/12
IT WO 2010140048 A3 * 2/2011 ..... B08B 3/12
JP EP 0824974 A1 * 2/1998 ..... A61L 2/183
JP EP 0824974 A4 * 5/2002 ..... A61L 2/183
WO 2010/125168 11/2010
WO 2010/140042 12/2010
WO 2010/140043 12/2010
WO 2010/140048 12/2010
WO 2011/045256 4/2011
WO 2011/138661 11/2011
WO 2011/158085 12/2011

* cited by examiner

MACHINE AND METHOD FOR TREATING CONTAINERS OF LIQUIDS

FIELD OF THE INVENTION

The present invention concerns a machine, and the corresponding method, for treating in an automated manner containers for liquids, for example but not exclusively, bottles, feeding bottles and drinking bottles or other containers or receptacles, for feeding animals.

In particular, with the present invention it is possible to wash, rinse, fill and close the containers in a substantially automated manner and in any case with a minimum manual intervention by an operator.

BACKGROUND OF THE INVENTION

Machines are known, used for washing containers for liquids, for example but not only, bottles, feeding bottles and drinking bottles or other, used for feeding animals such as, for example, laboratory guinea pigs or rodents or others.

It is known that, before washing, the containers are closed by means of suitable lids or capsules, which lids are shaped with a spout to allow the animal to drink the liquid contained in the container, and that they must be provided, at the end of washing, again closed and filled with other feed liquid.

It is known to provide machines for washing the containers, which comprise a plurality of operating stations disposed in line with each other, including a station for loading the closed containers, a station for removing the lids from the containers, or de-lidding, a washing station, a filling station and a station for reclosing the washed and filled containers, using said capsules.

In these known machines, except for the washing station where the containers are closed in a washing chamber and are subjected to predetermined automated steps of washing and rinsing, the remaining stations need many manual interventions and attention from the operators, in particular for loading, in order to position the containers in the filling station and to reclose the washed and filled containers with the lids.

In the field of such machines, the international applications WO-A-2010/125168, WO-A-2010/140042, WO-A-2010/140043, WO-A-2011/045256, WO-A-2011/138661 and WO-A-2011/158085 in the name of the present Applicant are known.

In particular, the international application WO-A-2010/140048 in the name of the present Applicant is also known, which describes a machine for treating containers of liquids which provides in general operations for the automatic movement of the containers and the lids.

This known machine comprises, in line in a first washing direction, a loading station for the containers to be subjected to the treatment, a de-lidding station in which the lids are removed from each of the containers, a washing station to subject to washing the de-lidded containers, and a closing station in which the washed containers are reclosed with the corresponding lids.

This known machine comprises a treatment device, able to effect the treatment of dirty lids, which is integrated with the machine for treating containers of liquids and is provided at least with a treatment station for the lids disposed in a second washing direction, operatively parallel to the first washing direction.

Other known washing machines are described in US-A-2003/165400, DE-A-4116333, U.S. Pat. No. 1,958,846, EP-A-0.824.974, EP-A-0.673.041 and FR-A-1.039.114.

Moreover, EP-A-0.017.287 describes a machine for treating closing lids that includes a support with bars connected at the ends by coupling plates, and distanced so that the lids are held between them and that a washing liquid can reach every side of them.

One purpose of the present invention is to obtain a machine, and perfect a method, which allows to remove the lids or capsules, to wash, fill and reclose the containers simply, economically and efficiently, in a substantially automated manner and reducing manual interventions by operators to a minimum.

Another purpose of the present invention is to obtain a machine, and perfect a method, which allows to subject the lids to treatment, in particular but not only, washing, without needing any manual transport steps from one station to another, in a reliable, repeatable and effective manner.

The Applicant has devised, tested and embodied the present invention to overcome the shortcomings of the state of the art and to obtain these and other purposes and advantages.

SUMMARY OF THE INVENTION

The present invention is set forth and characterized in the independent claims, while the dependent claims describe other characteristics of the invention or variants to the main inventive idea.

In accordance with the above purposes, a machine according to the present invention is used for treating containers and corresponding lids, each provided with a spout that extends from an upper surface, in order to contain a liquid for feeding animals, contained in containing baskets in an ordered manner according to a desired positioning pattern.

The machine according to the present invention comprises a first line, for washing, treating and filling the containers, from which the lids have already been removed, disposed in a first washing direction. The machine includes first transporter means to feed forward the containing baskets in which the containers are positioned. The machine also comprises a second line for washing and treating the lids removed from the containers, disposed in a second washing direction disposed parallel to the first direction.

According to possible forms of embodiment, the second line comprises a frame that supports, disposed in sequence in the second direction, a station for positioning the lids received, from a de-lidding station in the first line, a station for washing the lids, and a station for picking up the washed lids, from which they are picked up and transported in correspondence with a closing station of the first line.

In possible forms of embodiment, a mobile extractor member is provided, configured to automatically remove the lids from the containers in the de-lidding station, keeping them constrained and suspended in groups in coordination with the positioning pattern, and to transport them, in a third direction transverse to the first direction and the second direction, toward the second parallel line for washing and treating the lids at the positioning station.

In possible forms of embodiment, a member is provided, to reclose the containers with the lids, configured mobile to pick up the lids treated by the second line in order to transport them, positioned in groups in coordination with the positioning pattern, toward the first line at the pick-up station, in a fourth direction transverse to the first direction and the second direction, and to position them on the containers, reclosing them.

In possible forms of embodiment, second transporter means are provided, configured to transport in an automated manner the lids positioned by the extractor member according to the desired positioning pattern in the second direction, and comprising drawing means, selectively drivable in movement in the second direction, and a plurality of positioning and support units for the lids constrained to the drawing means, configured to cooperate with the extractor member and disposed in coordination with the positioning pattern in order to position one from the other independently, and to support the lids stably according to the positioning pattern.

Furthermore, according to possible forms of embodiment, the machine comprises first and second transverse movement means, upstream and downstream of the washing station of the second line, and configured to move respectively the extractor member and the reclosing member between a cantilevered position on the first line respectively at the de-lidding station and the reclosing station of the first line, and a cantilevered position on the second line respectively at the positioning station and the pick-up station of the second line.

According to some forms of embodiment, the first and second transverse movement means each comprise a cantilevered beam that extends transversely above the first and second line, respectively between the de-lidding station and the positioning station and between the reclosing station and the pick-up station.

In possible implementations, each cantilevered beam comprises a transmission member, driven by a respective motor and coupled with the extractor member and respectively with the reclosing member in order to move them.

With the parallel disposition of the second line with respect to the first line, it is possible to treat the lids automatically in coherent times in the second line, that is, substantially simultaneously with the washing of the containers performed in the first line.

In this way, the machine according to the present invention not only allows to fill and recluse the containers simply, economically and efficiently, but also to remove, wash and automatically reposition the lids on the containers, reducing to a minimum any manual interventions by the operators.

Furthermore, thanks to the stable and independent positioning of each lid in the positioning and support units, in coordination with the configuration both of the extractor member and the reclosing member, the machine according to the present invention allows to subject the lids to treatment, in particular but not only, washing, parallel to the treatment made on the containers, without needing manual transport steps from one station to another, all this in a reliable, repeatable and effective manner.

In variant forms of embodiment, the second washing direction of the second line is disposed parallel, at the side of the first washing direction of the first line.

In other variant forms of embodiment, the second washing direction of the second line is disposed parallel, above the first washing direction of the first line.

In other variant forms of embodiment, the second washing direction of the second line is disposed parallel, under the first washing direction of the first line.

In one form of embodiment, each positioning and support unit comprises a pair of support bars for the lids, disposed transversely to the second direction, connected by means of anchoring members to the drawing means.

The bars support at the upper part a plurality of centering and lateral holding means of the individual lids, disposed transversely distanced from each other along the bars at a desired pitch, coordinated with the pitch of the positioning pattern and each having a central positioning seating for the lids.

According to a variant, the centering and lateral holding means are disposed in rows parallel to the third direction of movement, coordinated with the rows of the positioning pattern of the lids when they are kept suspended by the extractor member and are present on the bars to a number coordinated with the number of lids present in each row of the positioning pattern.

According to one form of embodiment, the centering and lateral holding means are shaped annularly, with a lateral holding shell that is flared upward, so as to define an upper lead-in for the positioning of the lids.

According to one form of embodiment, holding means are disposed above the positioning and support units, configured to hold the lids around a desired operating position, acting as an end-of-travel against the upward displacement of the lids with respect to the centering and lateral holding means.

According to a variant form of embodiment, the holding means are configured as a fork and comprise pairs of holding bars disposed longitudinally, parallel to the second direction supported by a support frame.

Each pair of bars includes two bars disposed close to each other at a distance less than the transverse bulk of each of the lids and greater than the transverse bulk of the spouts, to define a positioning slit in which rows of spouts are inserted longitudinally, so that the lower surface of the bars defines an upper abutment for the upper surface of the lids.

The present invention also concerns a line for washing and treating lids removed from containers for containing a liquid for feeding animals, contained in containing baskets in an ordered manner according to desired positioning pattern.

The line is associable with an extractor member configured to automatically remove the lids from the containers, keeping them constrained and suspended in groups in coordination with the positioning pattern, and to transport them toward the washing and treatment line for the lids and to a member for reclosing the containers with the lids, configured to pick up the lids treated by the line in order to transport them positioned in groups in coordination with the positioning pattern in order to associate them with the containers, reclosing them.

The line comprises transporter means configured to transport in an automated manner the lids positioned by the extractor member according to the desired positioning pattern and comprising drawing means, able to be selectively driven in movement and a plurality of positioning and support units of the lids constrained to the drawing means, configured to cooperate with the extractor member and disposed in a coordinated manner to the positioning pattern in order to position one independently from the other and to support the lids stably according to the positioning pattern.

The present invention also concerns a method for treating containers and corresponding lids each provided with a spout which extends from an upper surface, to contain a liquid for feeding animals, which provides to:

position the containers in containing baskets in an ordered manner according to a desired positioning pattern, automatically wash, treat and fill the containers, from which the lids have been removed beforehand, and in parallel, automatically wash and treat the lids removed from the containers.

The method according to the present invention provides to:

automatically remove the lids from the containers, keeping them constrained and suspended in groups in coordination with the positioning pattern, and transport them toward the washing and treatment, transport in an automated manner the lids positioned according to the desired positioning pattern, independently from each other and supported stably according to the positioning pattern during the washing and treatment of the lids, pick up the treated lids and transport them positioned in groups in coordination with the positioning pattern toward the treated and filled containers, reclosing them.

BRIEF DESCRIPTION OF THE DRAWINGS

These and other characteristics of the present invention will become apparent from the following description of some forms of embodiment, given as a non-restrictive example with reference to the attached drawings wherein.

DESCRIPTION OF SOME FORMS OF EMBODIMENT

Figure 1:
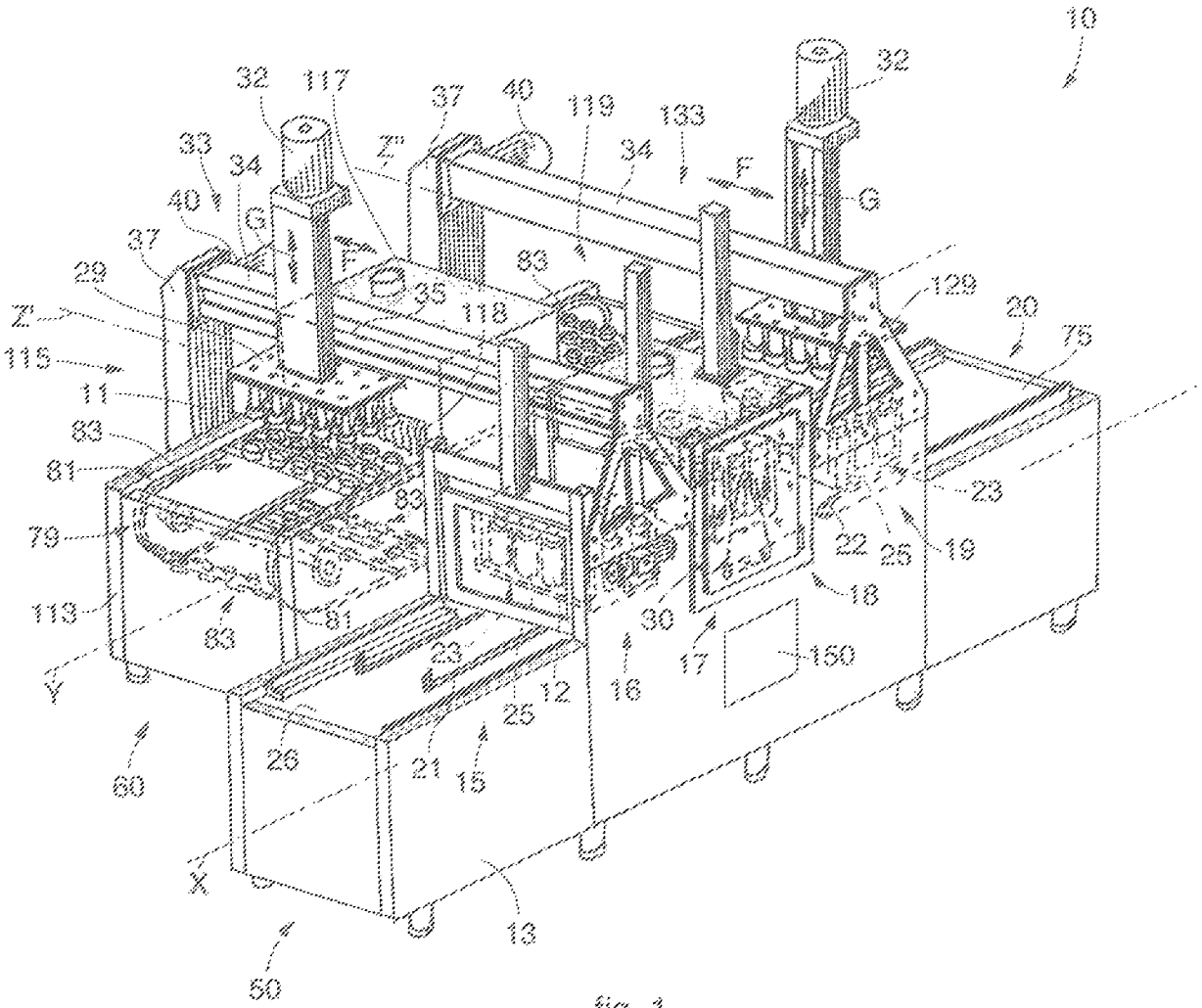
FIG. 1 shows schematically a perspective view of a machine for treating containers of liquids according to the present invention.

We shall now refer in detail to the various forms of embodiment of the present invention, of which one or more examples are shown in the attached drawing. Each example is supplied by way of illustration of the invention and shall not be understood as a limitation thereof. For example, the characteristics shown or described insomuch as they are part of one form of embodiment can be adopted on, or in association with, other forms of embodiment to produce another form of embodiment. It is understood that the present invention shall include all such modifications and variants.

With reference to the attached drawings, a machine 10 according to the present invention is used for treating feeding bottles 12 and corresponding metal lids 11 or capsules, for feeding small animals such as guinea pigs, mice, hamsters and others, for example used in research laboratories.

The feeding bottles 12 are normally closed at the top by means of the lids 11, which have an upper surface 11*b* from which a spout 11*a* projects, through which the animal drinks the feed liquid contained in the feeding bottle 12.

In this case, the feeding bottles 12 are disposed inside corresponding containing baskets 23, which are typically provided with a plurality of cells 25 that have a desired ordered disposition, for example in rows and columns, according to a determinate positioning pattern.

Each cell 25 (FIG. 2) is configured to accommodate a corresponding feeding bottle 12 and to keep it in a determinate ordered position with respect to the other feeding bottles 12.

In some forms of embodiment, the cells are configured to allow the feeding bottles 12 to be positioned and held inside the containing baskets 23 and to prevent them from accidentally coming out, in particular in a tilted condition, for example by 180°, of the containing basket 23.

In fact, in some forms of embodiment, during the washing of the feeding bottles 12, the containing basket 23 can be rotated, as will be explained in more detail hereafter, between two positions, rotated by 180° with respect to each other.

In particular, the machine 10 according to the present invention allows to carry out, in an automated manner, de-lidding, washing, filling and reclosing of the feeding bottles 12, and also the washing of the lids 11.

To this purpose, in possible implementations the treatment machine 10 can comprise a first line 50 for washing, treating and filling the feeding bottles 12, from which the lids 11 have already been removed, said line being disposed in a first washing direction X, and a second line 60 for washing and treating the lids 11 removed from the feeding bottles 12 (FIG. 1).

The second line 60 can be disposed in a second washing direction Y, disposed parallel, and in this case adjacent and to the side, to the first washing direction X. Preferably, to obtain a compact machine 10, the second line 60 is disposed parallel, in this case at the side, in close proximity to the first line 50.

In the case shown here by way of example, the first line 50 can comprise a first frame 13, with respect to which, in the first washing direction X, a loading station 15, a de-lidding station 16, a washing station 17, a filling station 18, integrated or autonomous with respect to the washing station 17, a reclosing station 19 and for example a discharge station 20 are all disposed in sequence (FIG. 1).

Figure 3:
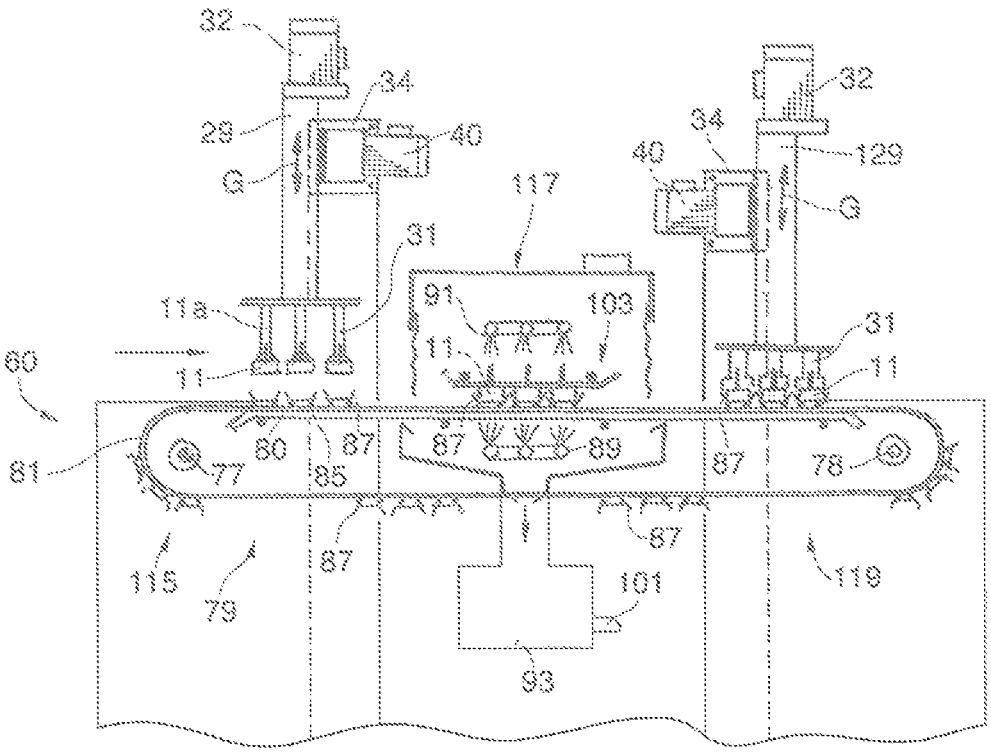
FIG. 3 shows schematically a lateral view of part of the machine in FIG. 1.

Furthermore, in the case shown here by way of example, the second line 60 can comprise a frame or second frame 113, with respect to which, in the second direction Y, a positioning station 115 for the lids 11 received from the de-lidding station 16, a washing station 117 for the lids and a station 119 to pick up the washed lids 11, are disposed in sequence. From the station 119 the lids 11 are picked up and transported in correspondence with the reclosing station 19 (FIGS. 1 and 3). By treatment of the lids we mean one or more of these operations: ultrasound washing, pre-wash, washing in cold water, washing in hot water, washing with chemical detergents and rinsing.

The movement of the feeding bottles 12 contained in the containing baskets 23 between the stations 15, 16, 17, 18, 19 and 20 in the first washing direction X of the first line 50 can be performed by means of the first transporter means 21, 22.

For example, the first transporter means 21, 22 can be continuous along the first line 50, or can be formed by two different consecutive transport sections, for example a pair of strips, belts, chains or similar transporter members, disposed one after the other in a determinate direction of feed, parallel to the first washing direction X, respectively to transport the feeding bottles 12 between the loading station 15, the de-lidding station 16 as far as the exit from the washing station 17, and between the filling station 18, the reclosing station 19 and the discharge station 20.

The loading station 15 can comprise a loading plane 26 on which the containing baskets 23 containing the feeding bottles 12, dirty and closed by the lid 11, are disposed.

The progressive positioning of the containing baskets 23 on the loading plane 26 is performed manually, or in an automated manner by means of movement means, rollerways, thruster means, translation means, or by means of an automatic handler, for example an anthropomorphic robotic arm.

The de-lidding station 16 is downstream of the loading station 15 while, after the de-lidding station 16, the washing station 17, the filling station 18, the closing station 19 and the discharge station 20 are provided.

Once the lids 11 have been removed from the feeding bottles 12, at the de-lidding station 16, the feeding bottles 12 are fed to the washing station 17.

The washing station 17, in some variant forms of embodiment, can include a tilting device 30 to tilt the containing baskets 23 for the 180° rotation, as indicated by arrow R in FIG. 1. For example, a solution of this type is described in the international application cited above, WO-A-2010/125168, in the name of the present Applicant, incorporated here in its entirety for reference. A tilting device 30 can be provided, for example, also associated with the de-lidding station 16.

In this variant, when provided by the selected treatment cycle, the tilting device 30 rotates the containing basket 23 contained in the washing station 17 by 180°, so that, when the feeding bottles 12 are in a tilted condition, that is, with the opening open downward, it is possible to perform the washing operation by delivering washing liquid from the bottom upward, as well as from the top downward, inside and outside the feeding bottles 12, respectively for washing and rinsing, by means of lower and upper delivery means 38, 39, such as nozzles (FIG. 2), disposed in the washing station 17 respectively above and below the containing basket 23.

The tilting device 30 is suitable to automatically rotate the containing baskets 23 exiting from the washing station 17 by 180°, so as to return the feeding bottles 12 contained therein with the corresponding apertures open upward.

The washing station 17 includes a circuit 41 for the washing liquid and a circuit, not visible in the drawings, for the feed liquid with which the feeding bottles 12 are filled.

Figure 2:
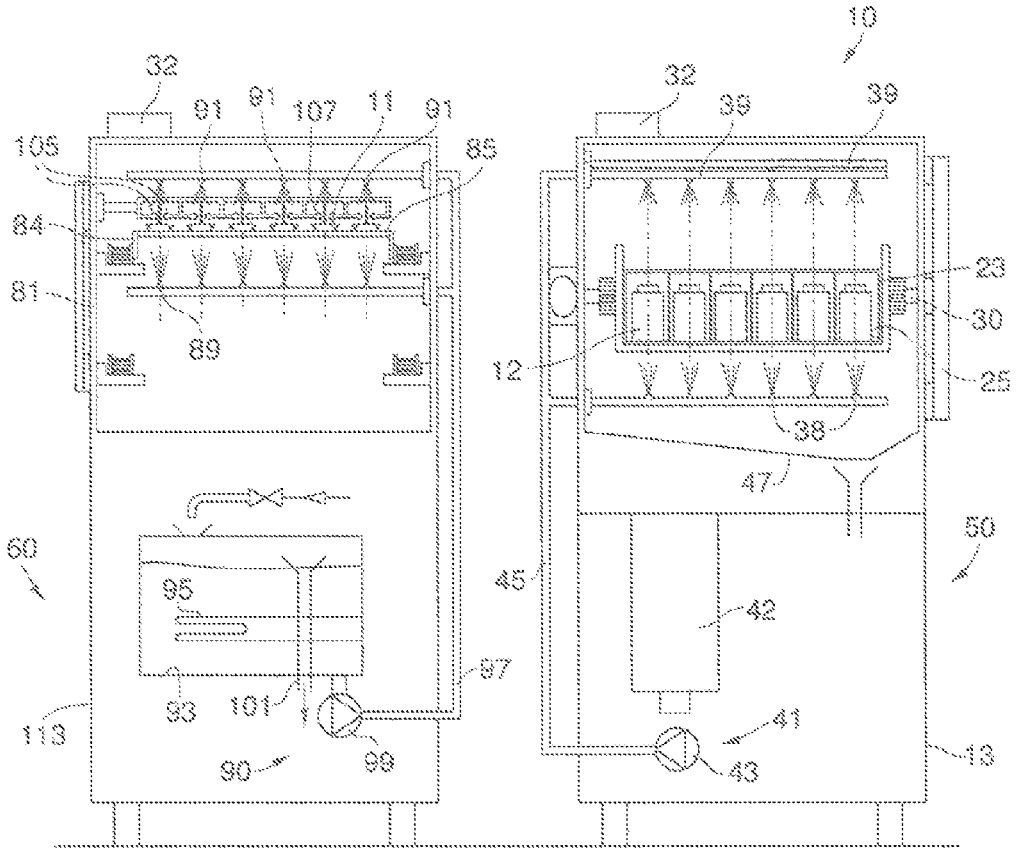
FIG. 2 shows schematically a front view of the machine in FIG. 1.

The circuit 41 comprises a tank 42 of washing liquid, a pump 43, a recirculation pipe 45, a discharge tank 47 under the lower delivery means 38 (FIG. 2).

The washing station 17 can also be equipped to effect rinsing and air drying of the feeding bottles 12.

The filling station 18, which in this case is integrated directly in the washing station 17 but which, in other variant forms of embodiment, can also be separated from it, comprises a plurality of filling nozzles disposed in suspension above the containing baskets 23, which can be represented by the upper delivery means 39, advantageously according to the positioning pattern of the feeding bottles 12 inside the containing baskets 23.

In this way, each feeding bottle 12 is filled from above precisely, substantially without wasting any liquid and guaranteeing great precision, uniformity and completeness in filling.

The de-lidding station 16 is associated with an extractor member 29 of the lids 11, which is configured to automatically remove the lids 11 from the feeding bottles 12 and, once removed, to keep them constrained and suspended to then transport them, held in an ordered condition, toward the second parallel line 60 for washing and treating the lids 11.

In some forms of embodiment, the extractor member 29 comprises a plurality of extraction heads 31 of the pneumatic type and mobile linearly, in this case vertically, by means of linear actuator means 32, as indicated by arrow G in FIG. 1.

The extraction heads 31 are disposed according to the positioning pattern of the feeding bottles 12 in the basket 23 and act automatically on the spouts 11*a* of each lid 11 to blow in pressurized air inside the feeding bottle 12 and cause the release of the lids 11 from the corresponding feeding bottles 12.

The extraction heads 31 are configured both to release the lids 11 from the feeding bottles 12 and also to hold them, always disposed according to the desired positioning pattern, so as to transport them and position them coherently with the same positioning pattern at the second parallel line 60.

An example of a device that can be used to open and hold lids in an extraction head 31 is described in the application UD2012A000107 filed in the name of the present Applicant on Jul. 6, 2012 and incorporated entirely here as reference.

Another example of a device for holding lids in a suspended condition used in an extraction head 31 is described in the international application WO-A-2011/138661 in the name of the present Applicant and incorporated entirely here as reference.

Furthermore, the extraction member 29 is also mobile horizontally, in a third direction Z', transverse, in this case substantially perpendicular, to the first direction X and second direction Y, so as to transport, as we said, the lids 11 in a suspended condition and positioned according to the desired positioning pattern, toward the second line 60.

To this purpose, first transverse movement means 33 are provided, which move the extractor member 29, as indicated by arrow F in FIG. 1, between a first position, cantilevered in cooperation with the de-lidding station 16, and a second position, cantilevered in cooperation with the positioning station 115.

In the case shown here by way of example, the first transverse movement means 33 can comprise a cantilevered beam 34 which, for example supported by at least one lateral column 37, in this case disposed externally at the side of the second line 60, can extend transversely above the lines 50, 60 between the de-lidding station 16 and the positioning station 115 (FIG. 1).

The cantilevered beam 34, which can for example be a rail or analogous longitudinal guide element, can include a transmission member 35 that extends in a direction transverse to the first direction X and the second direction Y, for example a rack, belt, strip or other, associated with a motor 40 configured to drive the transmission member 35 (FIGS. 1 and 3) and coupled with the extractor member 29 and driven to determine the desired alternate translation of the latter between the first and second position.

The reclosing station 19 of the first line 50 can comprise a reclosing member 129 of the feeding bottles 12 with the lids 11, configured to pick up the lids 11 treated by the second line 60 so as to transport them, held in a suspended and ordered condition, toward the first line 50 and to position them on the washed feeding bottles 12 that are presented on each occasion, contained in the appropriate containing baskets 23 at the reclosing station 19.

In some forms of embodiment, the reclosing member 129 is made like the extractor member 29. An example of a reclosing device used to hold and reclose lids in a reclosing member 129 is described in the application UD2012A000107 filed in the name of the present Applicant on Jul. 6, 2012 and is incorporated here in its entirety as a reference. Another example of a device for holding lids in a suspended condition used in a reclosing member 129 is described in the international application WO-A-2011/138661 in the name of the present Applicant and is incorporated here in its entirety as a reference.

The second line 60 can comprise second transporter means 79 configured to transport in an automated manner the lids 11 positioned by the extractor member 29 according to the desired positioning pattern in the second direction Y from the positioning station 115 inside the washing station 117, through an entrance 118, and subsequently as far as the pick-up station 119.

In the case of various types of treatment, in addition to and/or replacement of the ultrasound treatment, the washing station 117 of the lids 11 can also comprise one or more units chosen from pre-washing units, washing with cold water, washing with hot water, washing with chemical detergents and rinsing.

In this case, the second transporter means 79 are able respectively to transport the dirty lids 11, advantageously disposed in an ordered manner, from the positioning station 115 through the various treatment units of the washing station 117 possibly provided.

Figure 5:
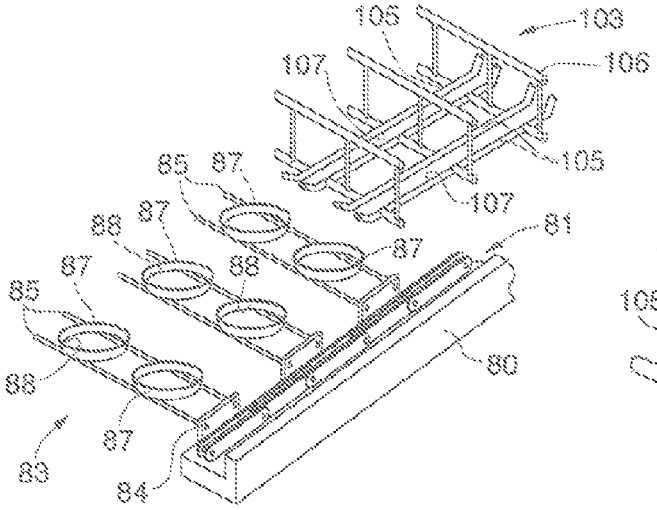
FIG. 5 is another detail of a part of FIG. 2.

The second transporter means 79 can comprise drawing means 81, for example with a chain, belt or suchlike, and are associated with longitudinal guide elements 80 (FIGS. 3 and 5).

The drawing means 81 develop along a closed-ring path in the second direction Y and are disposed on one side and possibly also on the other side of the second frame 113 in the second direction Y which are selectively drivable in movement. In order to drive the drawing means 81 a commanded pulley 77 is provided, driven by a motor (not visible in the drawings) and an idle pulley 78 (FIG. 3).

Moreover, the second transporter means 79 comprise a plurality of positioning and support units 83 to position each one independently of the other one and to support said lids 11 stably.

In particular, the positioning and support units 83 are associated to drawing means 81 and disposed along the second line 60 at a desired distance from each other, in coordination with the positioning pattern of the feeding bottles 12 in one of the containing baskets 23 and with the times of the treatment cycle, also taking into account the synchronization with the operations carried out by the first line 50.

The positioning and support units 83 cooperate with the extractor member 29, receiving from the latter the lids 11 removed from the feeding bottles 12 which are thus positioned from above, by means of the extractor member 29, automatically in the desired order.

In this way, each of the positioning units 83 is configured to maintain a desired plurality of lids 11 positioned coordinated with the positioning pattern of the feeding bottles 12 in the containing baskets 23.

The positioning and support units 83 of the lids 11 are constrained to the drawing means 81 and by these are made to advance in the second direction Y.

In some forms of embodiment, each positioning and support unit 83 comprises a pair of support bars 85 for the lids 11, which extend from one side to the other of the second frame 113 transverse to the second direction Y.

The bars 85 are connected by means of plates, or similar anchoring members 84 to the drawing means 81 so that they can be made to advance solidly with the latter.

Moreover, the bars 85 support on the upper part a plurality of centering and lateral holding means 87 of the individual lids 11, disposed transversely distanced from each other along the bars 85 at a desired pitch, coordinated to the pitch of the desired positioning pattern of the feeding bottles 12.

In particular, in possible implementations the centering and lateral holding means 87 are disposed in rows parallel to the third direction Z', coordinated with the rows of the positioning pattern of the lids 11 when kept suspended by the extractor member 29 and are present on the bars 85 to a number coordinated with the number of lids 11 present in each row of the positioning pattern. The centering and lateral holding means 87 can each have a central positioning seating 88. In this way, the centering and lateral holding means 87 allow to keep the lids 11 lying stably, in this case with the spout 11*a* facing upward, on a determinate lying plane in their passage along the second line 60, from the positioning station 115 to the washing station 117 as far as the pick-up station 119.

The centering and lateral holding means 87 can be made of metal material for example, or plastic material, possibly elastically deformable, for example a material with a rubber base or a polymeric material such as PTFE or similar.

In some forms of embodiment, the centering and lateral holding means 87 can be shaped with an annular shape, for example with a lateral holding shell which is tapered, that is, flared upward, so as to define an upper lead-in for the precise and centered positioning of the lids 11 and therefore have the positioning seating 88 central for the lids 11, in particular to allow the base of the lids to rest on the bottom of the positioning seating 88, with the corresponding spout 11*a* facing upward (FIG. 5). For example, the centering and lateral holding means 87 can be sleeves flared upward, or collar elements with section which progressively widens upward, like a truncated cone.

In the case where the centering and lateral holding means 87 are for example thrilled by elastically deformable material, that is, advantageously in conjunction with the flared shape as described above, it can facilitate the positioning of the lids 11 even if they are not perfectly aligned, or in axis, with the centering and lateral holding means 87.

Each of the centering and lateral holding means 87 can for example be constrained, for example by mechanical constraint such as bolting, riveting or also, depending on the construction material used, by means of welding, to the pair of bars 85 below, and is configured to house inside it, centering it correctly, one of the lids 11 positioned from above by the extractor member 29.

The internal diameter of the central positioning seating 88 of the centering and lateral holding means 87 can be slightly larger than the distance between two bars 85 of the corresponding pair of bars 85, so that, when placed inside the centering and lateral holding means 87, the lid 11 can rest lower down on the portion of both bars 85 included in the internal bulk of the centering and lateral holding means 87, remaining thus stably resting and supported.

Figure 4:
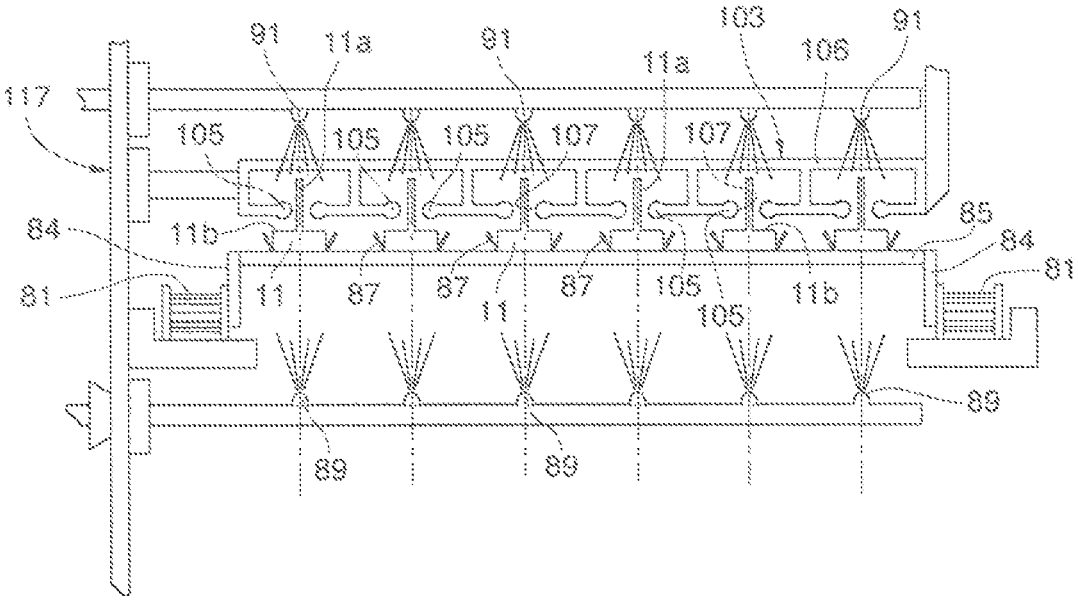
FIG. 4 is a detail of a part of FIG. 2.

In the washing station 117 a circuit 90 to deliver washing liquid can be installed, which can include lower and upper delivery means, such as nozzles 89, 91 (FIGS. 3 and 4) for the washing liquid of the lids 11 disposed below and above the positioning and support units 83 (FIG. 2).

The washing station 117 can also be equipped to carry out rinsing and air drying of the lids 11.

The lower and upper delivery means 89, 91 can be disposed in coordination with the position of the lids 11 to be washed, advantageously providing lower and upper delivery means 89, 91 disposed coordinately with the centering and lateral holding means 87. For example, an array of lower and upper delivery means 89, 91 can be provided, disposed on lower and upper lying planes, parallel to the lying plane of the centering and lateral holding means 87 and therefore of the lids 11, according to rows and columns coordinated with the positioning pattern.

In this way, dedicated lower and upper delivery means 89, 91 are provided for each of the lids 11 positioned in the centering and lateral holding means 87.

In some forms of embodiment, on the bottom of the frame 113, for example under the washing station 117, the circuit 90 can comprise a tank 93 to collect the washing liquid, provided for example with heating means 95, a possible recirculation pipe 97, for example using a pump 99, and possibly a discharge pipe 101 to discharge the spent treatment liquid.

In other forms of embodiment, the pump 99 may not be provided and the pressure of recirculation of the liquid can derive directly from the water supply.

In the washing station 117, between the positioning and support units 83 and the upper delivery means 91, holding means 103 are disposed, configured to hold, in particular in the axial direction of the spouts 11*a*, the lids 11 around a desired operating position, acting as an upward end-of-travel element for the possible axial displacement of the lids 11 with respect to the centering and lateral holding means 87.

In this way, because of the delivery of the washing liquid, in particular from the bottom with the lower delivery means 89, the invention prevents the lids 11 from inadvertently exiting completely from the centering and lateral holding means 87.

The holding means 103 are for example the fork type and comprise pairs of holding bars 105 disposed longitudinally, parallel to the second direction Y, and supported by a suitable support frame 106.

Each pair of bars 105 includes two bars 105 disposed near each other at a distance less than the transverse bulk or diameter of each of the lids 11 and greater than the transverse bulk of the spouts 11*a*, to define a positioning slit 107 (FIGS. 2, 4 and 5) in which the rows of spouts 11*a* of the lids 11 gradually fed can be inserted longitudinally.

The configuration of each of the positioning slits 107 delimited laterally by the bars 105 defines a fork which determines the holding of the lids 11 even if the washing liquid is delivered from below, since the upper surface 11*b* of the lids 11 abuts at the upper part against the lower surface of the bars 105.

The distance which is provided between the upper surface 11*b* of the lids 11 and the lower surface of the bars 105 is less than the depth of the centering and lateral holding means 87 in which the lids 11 are housed, so that, should the liquid delivered from below thrust the lids 11 upward, in any case the lifting travel allowed by the reciprocal configuration of bars 105 and centering and lateral holding means 87 would be such as to prevent the lids 11 from completely coming out.

Figure 6:
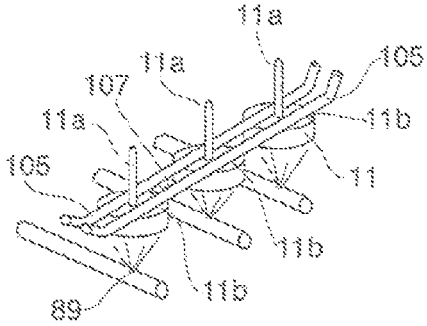
FIG. 6 is another detail of a part of FIG. 2.

For example FIG. 6 is a simplified representation, for convenience without showing the centering and lateral holding means 87, of the lids 11 that, because of the action of the lower delivery means 89, are moved upward and abut against the upper holding bars 105.

Once the lids 11 have been treated in the washing station 117, they are moved forward by the second transporter means 79 toward the pick-up station 119.

At this point, the reclosing member 129 is translated in correspondence to the pick-up station 119 of the second line 60, where it automatically picks up the washed lids 11 positioned according to the desired positioning pattern, keeping them constrained and suspended, to then transport them toward the first line 50 and associate them again to the feeding bottles 12 in the reclosing station 19 which, in the meantime, have been washed and refilled in the washing station 17 and in the filling station 18 which, as we said, can be integrated, as in FIG. 1, or separate and distinct.

In particular, the reclosing member 129 is also mobile horizontally, in a fourth direction Z", transverse, in the case shown by way of example substantially perpendicular, to the first direction X and second direction Y, in order to transport the lids 11, as we said, in a suspended condition and positioned according to the desired positioning pattern, toward the first line 50.

To this purpose, second transverse movement means 133 are provided, which can be for example similar to the first transverse movement means 33, which transport the reclosing member 129, as indicated by arrow F in FIG. 1, between a first position, disposed in cooperation with the pick-up station 119 of the second line 60 and a second position, disposed in cooperation with the reclosing station 19 of the first line 50.

In correspondence to the reclosing station 19, the lids 11 are put in cooperation with the refilled feeding bottles 12, which in the meantime have been brought, by the transporter means 23, to the reclosing station 19, where the reclosing member 129 automatically repositions the lids 11 on the corresponding feeding bottles 12, attaching the lids 11 hermetically to the feeding bottles 12.

Once the steps of closing all the feeding bottles 12 contained in a containing basket 23 are finished, the latter is moved toward the discharge station 30 positioning it on a corresponding discharge plane 75.

The baskets 23 thus positioned are picked up and positioned in corresponding discharge trolleys, of the known type and not shown.

It comes within the field of the present invention to provide, according to some variants, a command and control unit 150 (FIG. 1) of the programmable type, which is electronically connected to each of the operating stations 15, 16, 17, 18, 19, 20, 115, 117, 119, and/or to the command members provided, in order to selectively coordinate the different functioning cycles of the machine 10, actuating a sequence of work for the various washing cycles substantially without a break in continuity.

It is clear that modifications and/or additions of parts may be made to the machine 10 and method for treating containers of liquids as described heretofore, without departing from the field and scope of the present invention.

For example, in a variant form of embodiment, it can be provided that the second line 60 is disposed parallel to the first line 50, or with the second direction Y parallel to the first direction X, and above the first line 50.

Moreover, in another variant form of embodiment, it can be provided that the second line 60 is disposed parallel to the first line 50, or with the second direction Y parallel to the first direction X, and below the first line 50.

In any case, for these variant forms of embodiment, the transporter means for moving the members that extract and pick up the lids between the two lines 50 and 60 will consequently be adapted, compared with the variant in which the second line 60 is parallel to, and at the side of, the first line 50.

It is also clear that, although the present invention has been described with reference to some specific examples, a person of skill in the art shall certainly be able to achieve many other equivalent forms of machine 10 and method for treating containers of liquids, having the characteristics as set forth in the claims and hence all coming within the field of protection defined thereby.

The invention claimed is:

1. A machine for treating containers and corresponding lids each provided with a spout which extends from an upper surface, to contain a liquid for feeding animals, contained in containing baskets in an ordered manner according to a positioning pattern, comprising a first line for washing, treating and filling the containers, from which the lids have been removed beforehand, disposed in a first washing direction and which includes first transporter means to feed forward the containing baskets in which the containers are positioned, and a second line for washing and treating the lids removed from the containers disposed in a second washing direction disposed parallel to the first direction, wherein the second line comprises a frame that supports, disposed in sequence in the second direction, a positioning station for the lids received from a de-lidding station of the first line, a washing station for the lids and a pick-up station for the washed lids, from which they are picked up and transported in correspondence to a reclosing station of the first line, wherein a mobile extractor member is provided, configured to remove the lids automatically from the containers at the de-lidding station, keeping them constrained and suspended in groups in coordination with said positioning pattern, and to transport them, in a third direction transverse to the first direction and to the second direction, toward the second parallel line for washing and treating the lids, at the positioning station, wherein a reclosing member is provided to reclose the containers with the lids, configured mobile to pick up the lids treated by the second line at the pick-up station to transport them positioned in groups in coordination with said positioning pattern toward the first line at the reclosing station, in a fourth direction transverse to the first direction and to the second direction, and to position them on the containers, reclosing them, wherein second transporter means are provided, configured to transport in an automated manner the lids positioned by the extractor member according to the positioning pattern in the second direction and comprising drawing means, able to be selectively driven in movement in said second direction and a plurality of positioning and support units of the lids constrained to said drawing means, configured to cooperate with the extractor member and disposed in a coordinated manner to said positioning pattern in order to position one independently from the other and to support said lids stably according to said positioning pattern, wherein said machine also comprises first and second transverse movement means, upstream and downstream of the washing station of the second line, and configured to move respectively said extractor member and said reclosing member between a cantilevered position on the first line respectively at the de-lidding station and the reclosing station of the first line, and a cantilevered position on the second line respectively at the positioning station and the pick-up station of the second line, said first and second transverse movement means each comprising a cantilevered beam which extends transversely above the first line and the second line, respectively between the de-lidding station and the positioning station and between the reclosing station and the pick-up station, each cantilevered beam comprising a transmission member, driven by a respective motor and coupled to the extractor member and respectively to the reclosing member in order to move them.

2. The machine as in claim 1, wherein each positioning and support unit comprises a pair of support bars of the lids disposed transversely to the second direction, connected by anchoring members to said drawing means, the pair of support bars supporting at the upper part a plurality of centering and lateral holding means of the individual lids, disposed transversely distanced from each other along the pair of support bars at a pitch coordinated with a pitch of said positioning pattern and each of which has a central positioning seating for the lids.

3. The machine as in claim 2, wherein the centering and lateral holding means are disposed along rows parallel to the third direction of movement, coordinated with the rows of the positioning pattern of the lids when they are kept suspended by the extractor member and are present on said pair of support bars in a number coordinated with the number of lids present in each row of said positioning pattern.

4. The machine as in claim 2, wherein the centering and lateral holding means are shaped with an annular shape, with a lateral holding shell flared upward, so as to define an upper lead-in for positioning the lids.

5. The machine as in claim 2, wherein the internal diameter of the central positioning seating of each of the centering and lateral holding means is slightly larger than the distance between two bars of the corresponding pair of support bars.

6. The machine as in claim 2, wherein holding means are disposed above the positioning and support units, configured to hold the lids near a desired operative position, acting as an end-of-travel for the upward movement of the lids with respect to the centering and lateral holding means.

7. The machine as in claim 6, wherein said holding means are configured as a fork and comprise pairs of holding bars disposed longitudinally, parallel to said second direction supported by a support frame, each pair of holding bars including two bars disposed near to each other at a distance less than the transverse bulk of each of the lids and greater than the transverse bulk of the spouts, in order to define a positioning slit into which rows of spouts are longitudinally inserted, so that the lower surface of the bars defines an upper abutment for the upper surface of the lids.

8. The machine as in claim 6, wherein the second line comprises a circuit to deliver a washing liquid, the circuit includes lower and upper delivery means for the washing liquid for the lids, disposed below and above the positioning and support units, respectively, and the upper delivery means are disposed above said holding means.

9. The machine as in claim 2, wherein the second line comprises a circuit to deliver a washing liquid, the circuit includes lower and upper delivery means for the washing liquid for the lids, disposed below and above the positioning and support units, respectively.

10. The machine as in claim 8, wherein the lower and upper delivery means are disposed in a coordinated manner with the centering and lateral holding means.

11. The machine as in claim 1, wherein lower and upper delivery means for a washing liquid for the lids are provided below and above the positioning and support units.

12. The machine as in claim 1, comprising a tank to collect a washing liquid, provided with heating means, with a possible re-circulating pipe by a pump, and with a discharge pipe for the used washing liquid.

* * * * *